United States Patent [19]

Gustafson

[11] 4,349,807

[45] Sep. 14, 1982

[54] HEATING AND COOLING THERMOSTAT WITH ADJUSTABLE LIMITS AND METHODS OF MANUFACTURING AND OPERATING THE THERMOSTAT

[75] Inventor: Ralph W. Gustafson, Morrison, Ill.

[73] Assignee: General Electric Company, Fort Wayne, Ind.

[21] Appl. No.: 187,088

[22] Filed: Sep. 15, 1980

Related U.S. Application Data

[63] Continuation-in-part of Ser. No. 845,383, Oct. 25, 1977, Pat. No. 4,274,072.

[51] Int. Cl.[3] ..... H01H 37/22

[52] U.S. Cl. ..... 337/360; 29/622; 337/340

[58] Field of Search ..... 337/82, 84, 94, 340, 337/344, 360, 361; 165/26; 29/622; 236/1 C

[56] References Cited

U.S. PATENT DOCUMENTS

| | | | |
|---|---|---|---|
| 2,729,719 | 1/1956 | Kronmiller | 337/352 |
| 3,807,254 | 4/1974 | Brakebill | 337/360 |
| 4,078,601 | 3/1978 | Kolbow | 337/340 |
| 4,243,967 | 1/1981 | Irank | 337/340 |
| 4,249,155 | 2/1981 | Fitzgerald et al. | 337/360 |

*Primary Examiner*—William H. Beha, Jr.
*Attorney, Agent, or Firm*—Joseph E. Papin

[57] ABSTRACT

A thermostat adapted to regulate the temperature of a given space. The thermostat has a mode selecting member which is movable between a heating mode position and a cooling mode position. A temperature setting member is selectively movable for setting a selected operating temperature of the thermostat and has a preselected maximum heating set point temperature and a preselected minimum cooling set point temperature. One of the temperature setting member and the mode selecting member includes a pair of abutments engageable with the other of the temperature setting member and the mode selecting member when the mode selecting member is in its heating mode position and its cooling mode position to define the preselected maximum heating set point temperature and the preselected minimum cooling set point temperature of the temperature setting members, respectively.

A method of manufacturing a thermostat, a method of operating a thermostat and a method of establishing a preselected maximum heating set point temperature and a preselected minimum cooling set point temperature of a thermostat are also disclosed.

33 Claims, 10 Drawing Figures

HEATING AND COOLING THERMOSTAT WITH ADJUSTABLE LIMITS AND METHODS OF MANUFACTURING AND OPERATING THE THERMOSTAT

CROSS-REFERENCE TO RELATED APPLICATION

This application is a continuation-in-part of application Ser. No. 845,383 filed Oct. 25, 1977 (now U.S. Pat. No. 4,274,072 issued June 16, 1981) which is incorporated herein by reference.

FIELD OF THE INVENTION

This invention relates in general to temperature responsive devices and in particular to a thermostat, a method of manufacturing a thermostat, a method of operating a thermostat, and a method of establishing a preselected maximum heating set point temperature and a preselected minimum cooling set point temperature of a thermostat.

BACKGROUND OF THE INVENTION

In an effort to conserve power and fuel because of the recent shortages thereof, some of the prior art thermostats were provided with various and sundry schemes for limiting the maximum heating and cooling set point temperatures thereof.

In one of the prior art thermostats, such as that shown in U.S. Pat. No. 4,078,601 for instance, the heating and cooling temperature ranges were established by the manufacturer, and the temperature selector was manually movable between such ranges through an "off range". Of course, as the temperature selector was moved through the "off range", it actuated a switching mechanism for placing the thermostat in the proper operating mode depending upon whether the temperature selector was being manually moved toward the cooling temperature range or the heating temperature range thereof. At least one of the disadvantageous features of the above discussed prior art thermostat is believed to be that while an operator might have desired to manually select an increased heating set point temperature or a decreased cooling set point temperature, there was always the possibility of inadvertently moving the temperature selector into the "off range" of the thermostat.

In another of the prior art thermostats, such as the thermostat disclosed in U.S. Pat. No. 2,729,719 for instance, adjustable stops, such as set screws or the like, were located in the temperature indicating plate of the thermostat for motion limiting or abutting engagement with the temperature selector thereby to define maximum and minimum heating set point temperatures of the temperature selector. Of course, while this thermostat was provided with adjustable stops for preselecting the maximum and minimum heating set point temperature, it is believed that one of the disadvantageous or undesirable features of such thermostat was that it was operable only in a heating mode.

SUMMARY OF THE INVENTION

Among the several objects of the present invention may be noted the provision of an improved thermostat, an improved method of manufacturing a thermostat, an improved method of operating a thermostat and an improved method of establishing a preselected maximum heating set point temperature and a preselected minimum cooling set point temperature of a thermostat which overcome the above discussed disadvantageous or undesirable features, as well as others, of the prior art; the provision of such improved thermostat and methods in which means are provided to obviate movement of a mode selector between its operating positions in response to manual or selective movement of a temperature selector toward a set point temperature thereof; the provision of such improved thermostat and methods in which the maximum heating set point temperature and the minimum cooling set point temperature may be adjustably preselected; and the provision of such improved thermostat and methods having component parts utilized therein which are simple in design, economically manufactured, and easily assembled. These as well as other objects and advantageous features of the present invention will be in part apparent and in part pointed out hereinafter.

In general a thermostat in one form of the invention is adapted to regulate the temperature of a given space. The thermostat has means for selecting an operating mode thereof movable between a heating mode position and a cooling mode position. Means selectively movable for setting a selected operating temperature in the thermostat has a preselected maximum heating set point and a preselected minimum cooling set point. One of the temperature setting means and the mode selecting means includes a pair of means for abutting in engagement with the other of the temperature setting means and the mode selecting means when the mode selecting means is in its heating mode position and its cooling mode position to define the preselected maximum heating set point temperature and the minimum cooling set point temperature of the temperature setting means, respectively.

Also in general and in one form of the invention, a method is provided for operating a thermostat having a temperature selector movable to temperature settings therein and a mode selector operable generally in a heat mode position and a cool mode. In this method the temperature selector is moved into selected temperature settings within a pair of temperature setting ranges including a preselected maximum heating temperature setting and a preselected minimum cooling temperature setting, respectively. The temperature selector is engaged with the mode selector in one of its heating mode positions and its cooling mode position, and thereby the movement of the temperature selector within one of the temperature setting ranges past one of the preselected maximum heating temperature setting and the preselected minimum cooling temperature setting included in the one temperature setting range is obviated.

Further in general and in one form of the invention, a method is provided for establishing a preselected maximum heating set point temperature and a preselected minimum cooling set point temperature of a thermostat. The thermostat includes means operable generally for setting a selected set point temperature, means operable generally for selecting an operating mode of the thermostat and having at least a heating mode position and a cooling mode position, and a pair of adjusting means associated with one of the temperature setting means and the mode selecting means and adapted for adjustable movement with respect thereto. In this method, the temperature setting means is set in one of the preselected maximum heating set point temperature and the preselected minimum cooling set point temperature with the mode selector means in one of the heating mode position and the cooling mode position thereof, one of the adjusting means is adjusted with respect to the one of the temperature setting means and the mode selecting means to an adjusted position thereon and into abutting engagement with the other of the temperature setting means and the mode selecting means thereby to establish the one of the preselected maximum heating set point temperature and the preselected cooling set point temperature. The temperature setting means is moved to the other of the preselected maximum heating set point temperature and the preselected minimum cooling set point temperature and the mode selecting means to the other of the heating mode position and the cooling mode position thereof, and the other of the adjusting means is adjusted with respect to the one of the temperature setting means and the mode selecting means to another adjusted position thereon and into abutting engagement with the other of the temperature setting means and the mode selecting means thereby to establish the other of the preselected maximum heating set point temperature and the preselected minimum cooling set point temperature.

Still in general, a method in one form of the invention is provided for manufacturing a thermostat with the thermostat including a temperature selector operable about a pivot axis and having a preselected maximum heating set point temperature and a preselected minimum cooling set point temperature, a pair of adjustable stops associated with the temperature selector, a mode selector operable about a pivot axis and having a heating mode position and a cooling mode position, and an abutment on the mode selector. In this method, the abutment on the mode selector is positioned so that a radius line emanating from the pivot axis of the mode selector intersects with the abutment, and the temperature selector and the mode selector are mounted about the respective pivot axis thereof in the thermostat. The stops are arranged to engage the abutment with the mode selector in its heating mode position and its cooling mode position thereby to establish the preselected maximum heating set point temperature and the preselected cooling set point temperature of the temperature selector, and the forces of the engagements between the stops and the abutment are directed generally along the radius line emanating from the pivot axis of the mode selector and intersecting with the abutment.

Still further and in general, a method in one form of the invention is provided for manufacturing a thermostat with the thermostat including means for setting a selected set point temperature of the thermostat, means for selecting an operating mode of the thermostat and having a heating mode position and a cooling mode position, and a pair of adjustable stops. In this method, the temperature setting means and the mode selecting means are pivotally mounted in the thermostat, and the adjustable stops are associated with one of the temperature setting means and the mode selecting means. The temperature setting means is set in one of a preselected maximum heating set point temperature and a preselected minimum cooling set point temperature with the mode selecting means in one of the heating mode position and the cooling mode position thereof. One of the adjustable stops on the one of the temperature setting means and the mode selecting means is adjusted toward an adjusted position into abutting engagement with the other of the temperature setting means and the mode selecting means thereby to define the one of the preselected maximum heating set point temperature and the preselected minimum cooling set point temperature.

BRIEF DESCRIPTION OF THE DRAWINGS

Corresponding reference characters refer to corresponding parts throughout the several views of the drawings.

The exemplifications set out herein illustrate the preferred embodiment of the present invention in one form thereof, and such exemplifications are not to be construed as limiting the scope of such invention in any manner.

DETAILED DESCRIPTION OF THE PREFERRED EMBODIMENTS

Figure 6:
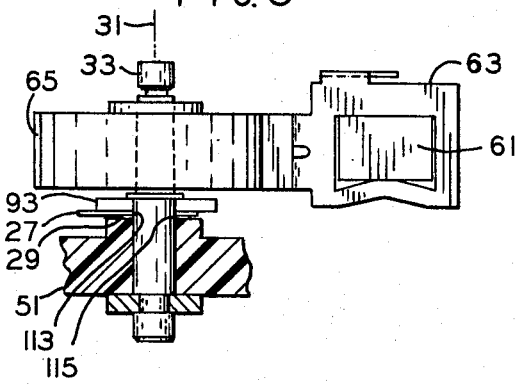
FIG. 6 is a side elevational view of the switch operating means of FIG. 5 illustrating the mounting thereof and of a temperature selecting means in the thermostat so as to also illustrate the principles which may be practiced in the method of manufacturing.
Figure 7:
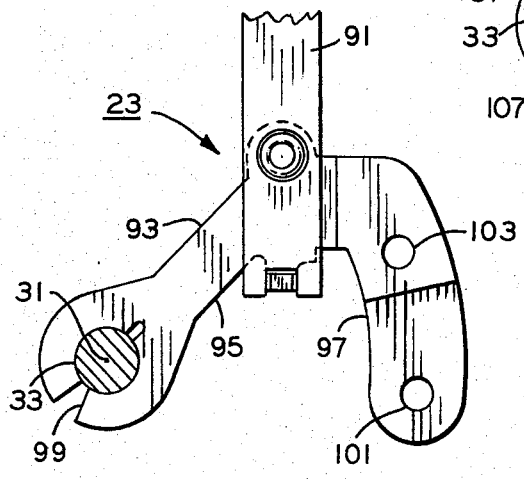
FIG. 7 is an enlarged fragmentary view of a temperature selector of the thermostat taken from FIG. 1 with adjusting members removed therefrom for clarity.
Figure 8:
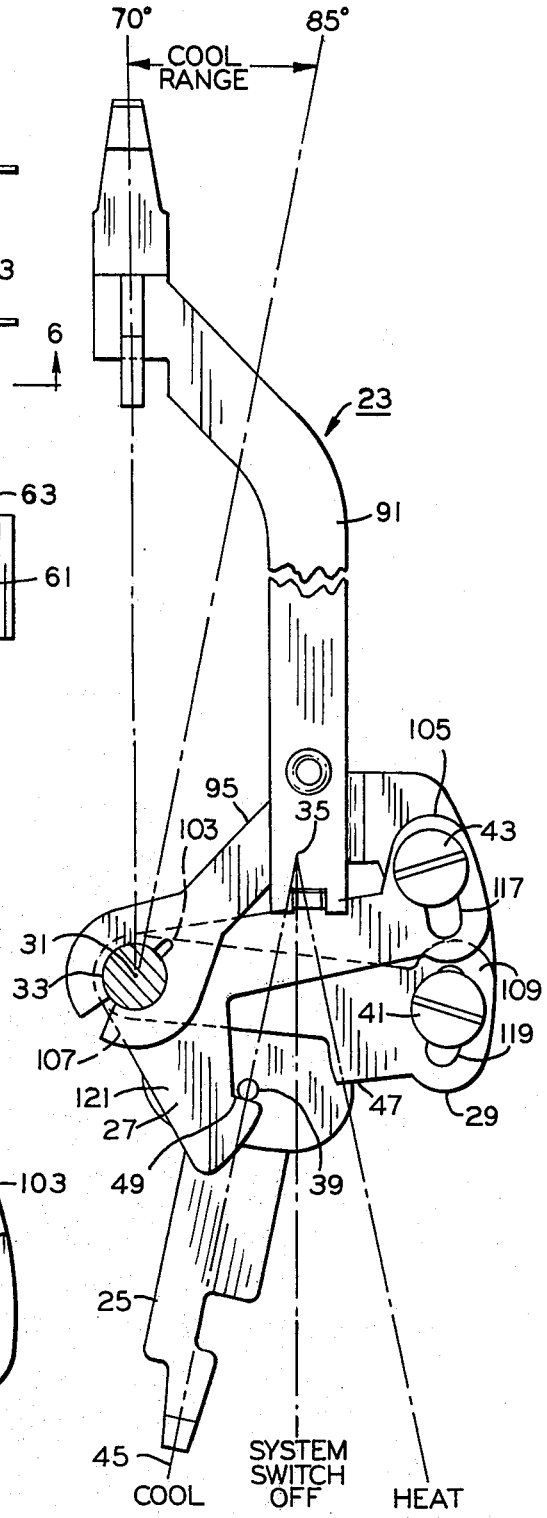
FIGS. 8, 9 and 10 are enlarged fragmentary views of a temperature selector and the mode selector of the thermostat taken from FIG. 1 and illustrating principles which may be practiced in a method of operating the thermostat and a method of adjustably establishing a preselected maximum heating set point temperature and a preselected minimum cooling set point temperature of the thermostat in one form of the invention, respectively.
Figure 9:
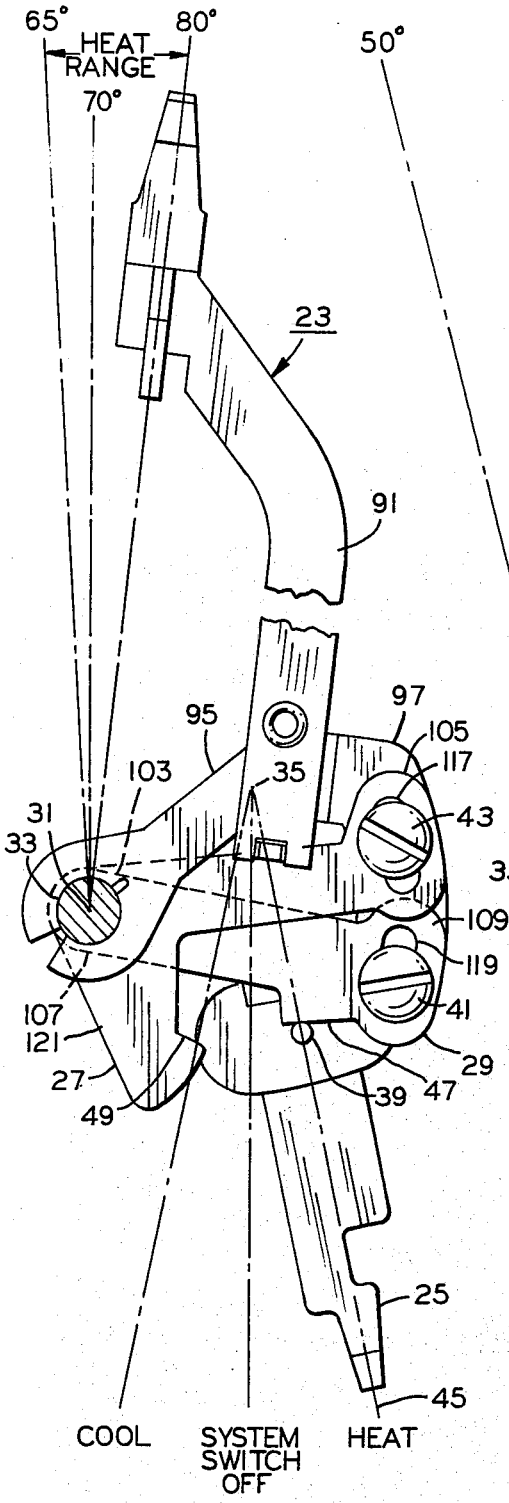

Referring now to the drawings in general, there is illustrated in one form of the invention a method for establishing a preselected maximum heating set point temperature and a preselected minimum cooling set point temperature of a thermostat 21 (FIGS. 1–10). Thermostat 21 includes means, such as a temperature selector 23 or the like for instance, operable generally for setting a selected set point temperature and also means, such as a mode selector 25 or the like for instance, operable generally for selecting an operating mode of the thermostat and having at least a heating mode position and a cooling mode position (FIGS. 1–4 and 8–10). Thermostat 21 further includes a pair of adjusting means, such as adjusting links 27, 29 or the like for instance, associated with temperature setting means or temperature selector 23 and adapted for adjustable movement with respect to the temperature selector and mode selecting means or mode selector 25 (FIGS. 1 and 8–10). In this method, temperature selector 23 is set or otherwise positioned in the preselected maximum heating set point temperature with mode selector 25 in its heating mode position, and adjusting link 27 is adjusted or otherwise moved toward an adjusted position on the temperature selector and into abutting engagement with the mode selector (FIG. 9). Temperature selector 23 and mode selector 25 are then moved to their respective preselected minimum cooling set point temperature and cooling mode position, and adjusting link 29 is adjusted or otherwise moved to an adjusted position on the temperature selector and into abutting engagement with the mode selector (FIG. 8). While the preselected maximum heating set point temperature is discussed above as being first established prior to the establishment of the preselected minimum cooling set point temperature, it is contemplated that the preselected minimum cooling set point temperature may be first established within the scope of the invention so as to meet at least some of the objects thereof.

Figure 3:
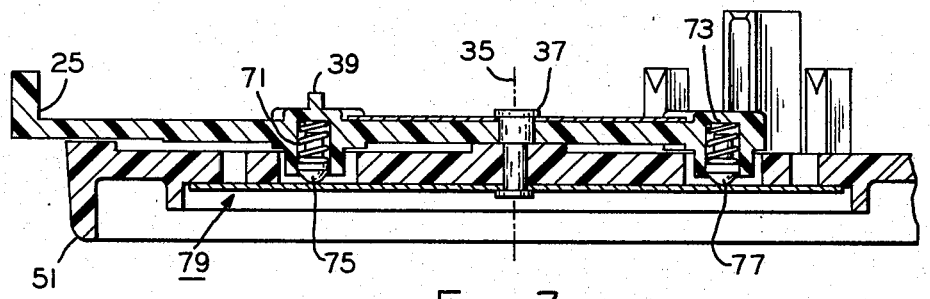
FIGS. 3 and 4 are sectional views taken along lines 3—3 and 4—4 in FIG. 2, respectively.

More particularly and with specific reference to FIGS. 3, 6 and 9, temperature selector 23 and adjusting links 27, 29 are respectively pivotally or rotatably movable generally about a centerline axis 31 of means, such as a pivot pin or shaft 33 or the like for instance, for mounting them, and mode selector 25 is pivotally or rotatably movable generally about a centerline axis 35 of means, such as for instance another pivot pin or shaft 37 or the like, for mounting it. With mode selector 25 in the heat operating mode or heating mode position thereof, as best seen in FIG. 9, temperature selector 23 may be pivotally moved in response to a manual or operator applied force thereon about pivot pin 33 into the preselected maximum heating temperature, say 80° F. for instance, desired for thermostat 21. With temperature selector 23 so set to indicate the preselected maximum heating temperature, heat adjusting link 29 may be pivotally moved or otherwise adjusted in response to an operator applied force thereon about pivot pin 33 into engagement with means, such as for instance an abutment or stop 39 or the like, for abutment therewith provided on mode selector 25. Upon this movement of heat adjusting link 29 relative to temperature selector 23 and mode selector 25 into an adjusted position in the stopping or abutting engagement with abutment or abutment means 39 of the mode selector, the heat adjusting link is releasably or adjustably secured by suitable means, such as for instance a set screw 41 or the like, to temperature selector 23. Thus, the interconnection of set screw or securing means 41 between heat adjusting link 29 and temperature selector 23 releasably retains or otherwise releasably secures or disposes the heat adjusting link against displacement from its adjusted position defining the preselected maximum heating temperature chosen for thermostat 21, and thereafter the heat adjusting link and the temperature selector are, of course, conjointly pivotally movable about pivot pin 33 therefor. When heat adjusting link 29 is secured in its adjusted position to temperature selector 23, it may be noted that the engagement between the heat adjusting link and abutment 39 on mode selector 25 obviates or otherwise positively limits manual movement of the temperature selector to temperature setting above or in excess of the preselected maximum heating temperature chosen for thermostat 21. However, temperature selector 23 may be manually moved into temperature settings in an adjustable or preselected heat range between the preselected maximum heating temperature and a low temperature setting, say for instance 65° F., of thermostat 21.

In order to establish the preselected minimum cooling temperature of thermostat 21, mode selector may be pivotally moved in response to a manual or operator applied force exerted thereon generally about pivot pin 37 from the heating mode position into the cool mode or cooling mode position thereof, and abutment 39 on the mode selector is, of course, conjointly movable therewith toward a position displaced or otherwise disengaged from heat adjusting link 29 in its adjusted position secured to temperature selector 23. With mode selector 23 so disposed in its cooling mode position, temperature selector 23 may be pivotally moved in response to a manual or operator applied force thereon about pivot pin 33 into the preselected minimum cooling temperature, say 75° F. for instance, desired for thermostat 21. With temperature selector 23 so set to indicate the preselected minimum cooling temperature, cooling adjusting link 27 may be pivotally moved or otherwise adjusted in response to an operator applied force thereon about pivot pin 33 into engagement with abutment 39 on mode selector 25. Upon this movement of cooling adjusting link 27 relative to temperature selector 23 and mode selector 23 into an adjusted position in the stopping or abutting engagement with abutment 39 of the mode selector, the cooling adjusting link is releasably or adjustably secured by suitable means, such as for instance a set screw 43 or the like, to temperature selector 23. Thus, the interconnection of set screw or securing means 43 between cooling adjusting link 27 and temperature selector 23 releasably retains or otherwise releasably secures or disposes the cooling adjusting link against displacement from its adjusted position defining the preselected minimum cooling temperature chosen for thermostat 21, and thereafter the cooling adjusting link and the temperature selector are, of course, conjointly pivotally movable about pivot pin 33 therefor. When cooling adjusting link 27 is secured in its adjusted position to temperature selector 23, it may be noted that the engagement between the cooling adjusting link and abutment 39 on mode selector 25 obviates or otherwise positively limits manual movement of the temperature selector to temperature settings below or less than the preselected minimum cooling temperature chosen for thermostat 21. However, temperature selector 23 may be manually moved into temperature setting in an adjustable or preselected cooling range between the preselected minimum cooling temperature and a high temperature setting, say for instance 85° F., of thermostat 21.

Figure 10:
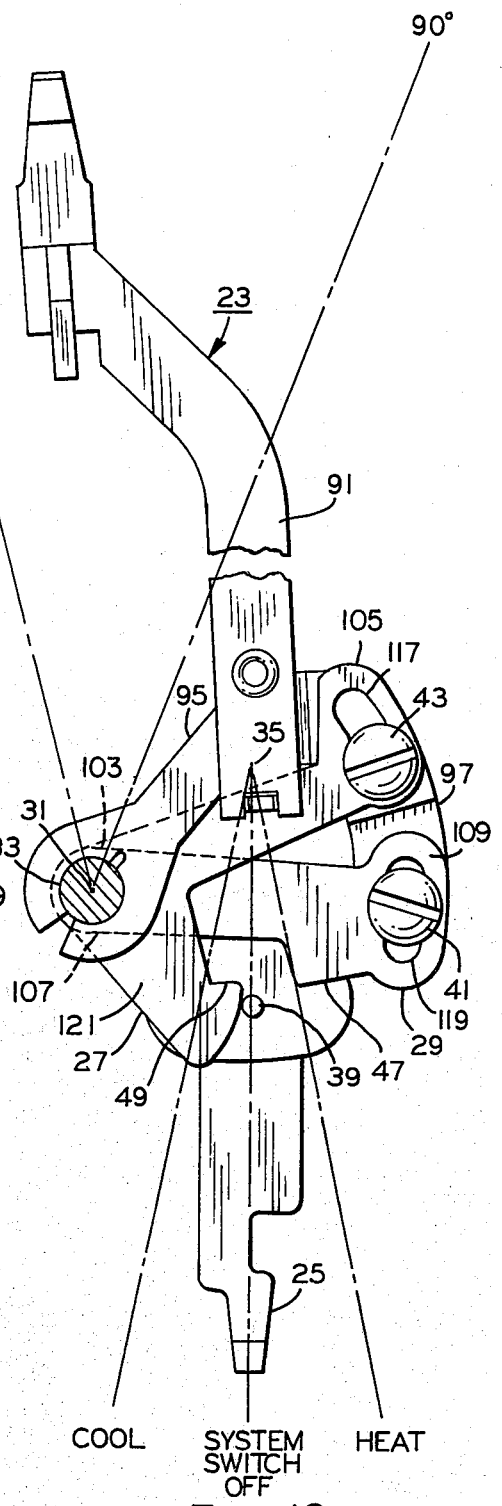

When mode selector is manually moved to an off position intermediate the heating mode position and the cooling mode position thereof, as best seen in FIG. 10, abutment 39 on the mode selector is, of course, conjointly movable therewith toward a position displaced or otherwise disengaged from both cooling adjusting link 27 and heat adjusting link 29 in their respective adjusted positions secured to temperature selector 23. Therefore, with mode selector 25 in its off position, temperature selector 25 may be pivotally moved or free-wheeled in response to an operator applied force exerted thereon about pivot pin 33 between the aforementioned low and high temperature settings, i.e., between 50° F. and 90° F., chosen for thermostat 21. While adjusting links 27, 29 are described herein as being adjustably secured to temperature selector 23 and abutment 39 is described herein as being on moded selector 25, it is contemplated that abutment 39 may be provided on the temperature selector and the adjusting links may be adjustably secured to the mode selector within the scope of the invention so as to meet at least some of the objects thereof. Furthermore, it is also contemplated that adjusting links 27, 29 may be respectively pivoted about other mounting means therefor other than pivot pin 33 within the scope of the invention so as to meet at least some of the objects thereof.

With reference again in general to the drawings and recapitulating at least in part with respect to the foregoing, there is also illustrated in one form of the invention a method of manufacturing thermostat 21 with the thermostat including temperature selector 23, mode selector 25, and a pair of adjustable stops, such as for instance adjusting links 27, 29 (FIGS. 1–10). In this method, temperature selector 23 and mode selector 25 are respectively pivotally or rotatably mounted or otherwise movably assembled in thermostat 21, and adjusting links 27, 29 are associated or otherwise arranged with one of the temperature selector and the mode selector (FIGS. 2, 3, 5 and 8–10). Temperature selector 23 is set in one of the preselected maximum heating set point temperature and the preselected minimum cooling set point temperature with mode selector 25 in one of the heating mode position and cooling mode position thereof (FIGS. 8 and 9). One of adjusting links 27, 29 associated with the one of temperature selector 23 and mode selector 25 is adjusted toward its adjusted positions into abutting engagement with the other of the temperature selector and the mode selector thereby to define the one of the preselected maximum heating set point temperature and the preselected minimum cooling set point temperature (FIGS. 8 and 9).

Further, there is also illustrated another method in one form of the invention for manufacturing or otherwise assembling thermostat 21 which includes: temperature selector 23 having pivot axis 31 and also both the preselected maximum heating set point temperature and the preselected minimum cooling set point temperature adjusting links 27, 29 associated with the temperature selector; and, mode selector 25 having pivot axis 35 and also at least heating and cooling mode positions with abutment 39 on the mode selector (FIGS. 1–10). In this method, abutment 39 is positioned or otherwise predeterminately located on mode selector 25 so that a radius line 45 emanating from pivot axis 35 of the mode selector intersects with the abutment (FIGS. 8 and 9). Temperature selector 23 and mode selector 25 are mounted about respective pivot axis 31, 35 thereof (FIGS. 3, 6, 8 and 9). Adjusting links 27, 29 are arranged or otherwise disposed in preselected adjusted positions to engage abutment 39 when mode selector 25 is in its heating and cooling mode positions thereby to establish the preselected maximum heating set point temperature and the preselected minimum cooling set point temperature of temperature selector 23, the forces of the engagements between the adjusting links and the abutment are directed generally along radius line 45 emanating from pivot axis 35 of the mode selector and intersecting with the abutment (FIGS. 8 and 9).

More particularly and with specific reference to FIGS. 3, 6, 8 and 9, adjusting links 27, 29 are provided with abutting or stop portions or surfaces, such as edges or margins 47, 49 or the like thereon, and it may be noted that such stop surfaces 47, 49 are predeterminately arranged or otherwise located so as to extend generally perpendicular to radius line 45 and in engagement with abutment 39 on mode selector 25 when the adjusting links are in the respective adjusted position thereof defining the preselected maximum heating temperature and the preselected minimum cooling temperature of thermostat 21. Due to this predetermined generally perpendicular location of stop surfaces 47, 49 on adjusting links 27, 29 with radius line 45 when engaged with abutment 39 on mode selector 25, any applied force exerted on temperature selector 23 by an operator is transmitted or otherwise transferred or directed through the stop surfaces onto abutment 39 generally along radius line 45 toward pivot axis 35 of mode selector 25 about its pivot pin 37. Since the operator applied force exerted on temperature selector 23 is transferred through the respective engagements between stop surfaces 47, 49 of adjusting links 27, 29 and abutment 39 of mode selector 23 so as to be directed generally along radius line 45 toward pivot axis 35 of the mode selector, it may be further noted that such transferred operator applied force is ineffective to cause movement or displacement of the mode selector from either of the heat mode position and the cool mode position thereof. In other words, mode selector 25 may not be inadvertently driven or moved from either the heat mode position and cool mode position into the off position thereof by an operator applied force exerted on temperature selector 23.

With reference again in general to the drawings and recapitulating at least in part with respect to the foregoing, there is shown in one form of the invention thermostat 21 adapted to regulate the temperature of a given space (FIGS. 1–10). In thermostat 21, means, such as mode selector 25 or the like for instance, is movable between the heating and cooling mode positions for selecting an operating mode of the thermostat, and means, such as for instance temperature selector 23 or the like, is selectively movable for setting a selected operating or set point temperature of the thermostat including the preselected maximum heating temperature and the preselected minimum cooling temperature (FIGS. 3, 6, 8 and 9). A pair of means, such as for instance adjusting links 27, 29 or the like, are associated with temperature selector 23 for abutting in engagement with mode selector 25 when it is in the heating and cooling mode positions thereof so as to define the preselected maximum heating temperature and the preselected minimum cooling temperature, respectively (FIGS. 8 and 9).

More particularly and with specific reference to FIGS. 1–6, thermostat 21 has a base or base plate 51 on which a switch device 53 is mounted, and a plurality of switch means supporting terminals 55 are respectively connected by a plurality of leads 57 extending through the base plate with an electrical circuit (not shown) of the thermostat. Of course, switch device 53 is controlled or otherwise operated by a pair of spaced apart magnetic material elements 59, 61 carried in a bracket 63 therefore, and the bracket is mounted to a radially outer end of a bimetal element 65 while a radially inner end thereof is secured to pivot post 33. If a more detailed discussion of switch device 53, bracket 63 and magnets 59, 61 and bimetal element 59, their respective respective operations and mounted relation on base plate 51 with respect to each other as well as other components of thermostat 21 is desired reference may be had to the aforementioned application Ser. No. 845,383 filed Oct. 25, 1977 (now U.S. Pat. No. 4,274,072 issued June 16, 1981) which is incorporated herein by reference.

Figure 4:
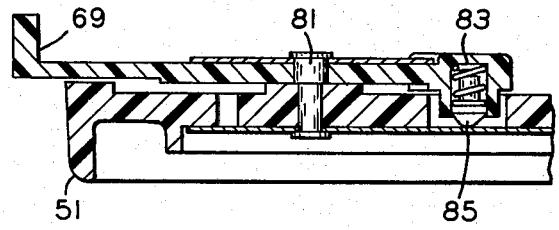

Base plate 51 of thermostat 21 is provided with means, such as a plurality of split posts 67 or the like for instance, for releasable securing engagement with a cover (not shown) of the thermostat, and such cover may contain temperature setting indicia appropriately positioned with respect to temperature selector 23 as well as other indicia concerning the settings or positions of mode selector 25 and a fan switch 69. As best seen in FIG. 3, system or mode selector switch 25 is a generally flat elongate lever which is pivotally or rotatably mounted on pivot post or pin 37 secured to base plate 51, and the lever is provided with a pair of spaced apart recesses 71, 73 which house a pair of spring loaded, indexing type contacts 75, 77, respectively. Contacts 75, 77 of mode selector 25 are resiliently urged toward electrical contacting engagement with a stamped-out metallic circuit board or plate, indicated generally at 79. Of course, mode selector 25 is manually pivotally movable about pivot pin 37 between its three positions, i.e. the off, heat, and cool positions thereof, so as to select the desired operating mode of thermostat 21, and upon such pivotal movement of the mode selector, contacts 75, 77 are respectively resiliently urged or indexed into electrical contacting engagement between various stamped-out parts (not shown) of circuit plate 79 to effect the heating or cooling mode operations of the thermostat or to turn off the thermostat. As best seen in FIG. 4, fan switch 69 also is a generally flat elongate lever which is pivotally or rotatably mounted on a pivot post or pin 81 secured to base plate 51, and a recess 83 is provided in the fan switch generally adjacent an end thereof. Another spring loaded, indexing type contact 85 is housed in recess 83 of fan switch 69 and is resiliently urged toward electrical contacting engagement with circuit plate 79. Of course, fan switch 69 is manually pivotally movable about pivot pin 81 between an "on" position and an "automatic" position so as to select the desired operation of a fan or blower (not shown) during the heating or cooling mode operation of thermostat 21. Upon the pivotal movement of fan switch 69, contact 85 is resiliently urged or indexed into electrical contacting engagement between various stamped-out parts (not shown) of circuit plate 79 to effect the aforementioned desired operation or mode of the fan. Although mode selector 25, fan switch 69 and circuit plate 79 are described hereinabove in one form of the invention, it is contemplated that other types or forms of mode selector 25, fan switch 69 and circuitry may be utilized in thermostat 21 so as to meet the objects and advantageous features thereof. Further, while circuit plate 79 is illustrated as secured by pivot pins 37, 81 to base plate 51 of thermostat 21, it is contemplated that other means for securing the circuit plate to the base plate may also be utilized within the scope of the invention so as to meet at least some of the objects thereof. Further, if a more detailed discussion of the circuitry included in circuit plate 51 is desired, reference may be had to the thermostat circuitry disclosed in the Wiley M. Hummel U.S. Pat. No. 4,016,520 issued Apr. 5, 1977 which is incorporated herein by reference.

Figure 1:
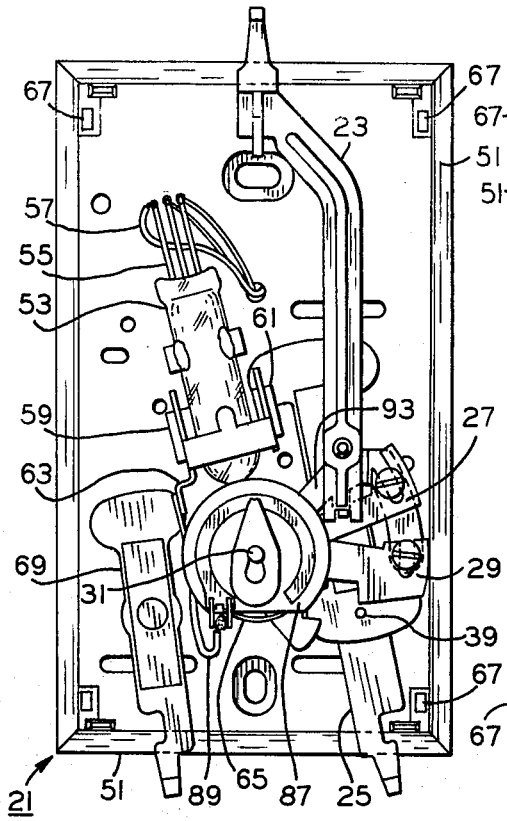
FIG. 1 is a plan view illustrating a thermostat in one form of the invention with a cover thereof removed for clarity.
Figure 2:
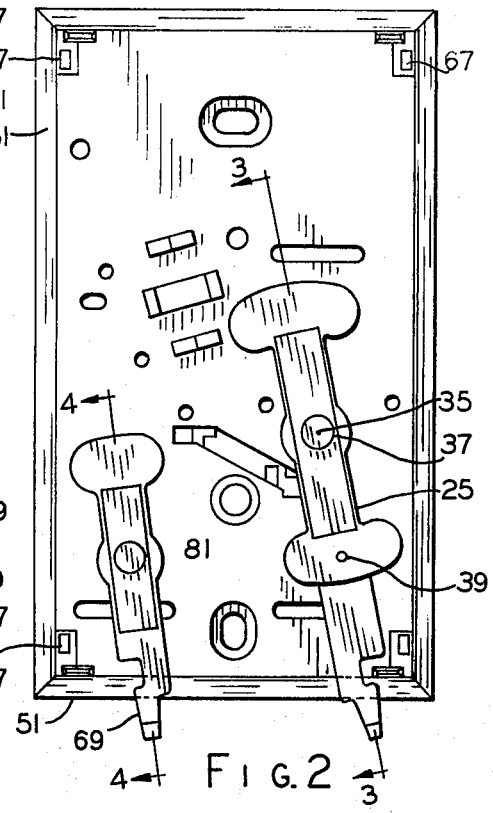
FIG. 2 is a plan view of a base plate of the thermostat of FIG. 1 with a fan selector switch and a system or mode selector switch mounted thereto and illustrating in one form of the invention principles which may be practiced in a method of manufacturing the thermostat in one form of the invention.

As shown in FIG. 1, a heat anticipator assembly 87 is secured to the upper end of pivot pin 33 so as to extend generally adjacent and over bimetal element 65 secured to the pivot pin. Heat anticipator assembly 87 is connected by a lead 89 in circuit relation with circuit plate 79, and when energized, the heat anticipator assembly is operable to transmit anticipation heat directly to bimetal element 65 so as to prevent temperature overshoot or undershoot, as is well known in the art. If a more detailed discussion of the function of a heat anticipator, such as heat anticipator assembly 87, in a thermostat is desired, reference may be had to the Dann W. Denny application Ser. No. 750,280 filed Dec. 13, 1976 (now U.S. Pat. No. 4,114,681 issued Sept. 19, 1978) which is incorporated herein by reference.

Temperature selector 23 includes a temperature indicating arm 91 and a pivoting body or body portion 93 having a pair of integral spaced apart legs 95, 97, and the lower end of arm 91 is fixedly interconnected with body portion 93 between legs 95, 97 thereof by suitable means, as best seen in FIG. 7. The free end of leg 95 is bifurcated at 99 so as to receive in driving or gripping engagement pivot pin 33, and in response to such gripping engagement, movement of temperature selector 23 to a selected temperature setting effects conjoint pivotal movement of pivot pin 33 therewith. A pair of predeterminately spaced apart apertures or openings 101, 103 are provided through leg 97 on body portion 93 of temperature selector 23, and the openings are adapted to threadedly receive set screws 41, 43, respectively, so as to maintain adjusting links 27, 29 in the adjusted positions thereof. While temperature selector 23 is disclosed as comprising interconnected temperature indicating arm 91 and body portion 93, it is contemplated that a temperature selector of a unitary or integral construction may be utilized within the scope of the invention so as to meet at least some of the objects thereof.

Adjusting links 27, 29 are formed of a suitable, generally thin metallic material and have a pair of generally opposite ends or end portions 103, 105 and 107, 109, respectively. Means, such as a pair of pivot openings 113, 115 or the like for instance, are provided through adjusting links 27, 29 adjacent opposite ends 103, 107 thereof for pivotally or rotatably mounting relation about pivot pin 33, and opposite ends 103, 107 of the adjusting links are arranged at least in part in overlaying relation with each other and a part of leg 95 of temperature selector 23, respectively. Opposite ends of temperature selector 23, respectively. Opposite ends 105, 109 of adjusting links 27, 29 are arranged at least in part in overlaying relation with leg 97 of temperature selector 23, and a pair of generally arcuate adjusting or set screw receiving slots 117, 119 are provided through opposite ends 105, 109 of the adjusting links so as to be arranged generally in aligned relation with set screw receiving openings 101, 103 in leg 97 of temperature selector 23. It may be noted that abutting edge 47 is provided on adjusting link 29 adjacent opposite end 109 thereof, and abutting edge 49 is provided on an extension means or depending finger 121 which is integrally formed with opposite end 107 of adjusting link 27. Further, with set screws 41, 43 threadedly received in openings 101, 103 provided therefor in leg 97 of body 93 on temperature selector 23, the set screws extend through slots 117, 119 in adjusting links 27, 29 so as to permit the adjusting movement of the adjusting links to their adjusted positions defining the preselected maximum heating temperature and the preselected minimum cooling temperature, as previously discussed. When adjusting links 27, 29 are in their adjusted positions, set screws 41, 43 may be torqued down to engage the heads thereof with opposite ends 105, 109 of the adjusting links extending about slots 117, 119 therein so as to grippingly engage opposite ends 105, 109 of the adjusting links with arm 97 of body 93 in temperature selector 23. In this manner, the tightening or torqueing down of set screws 41, 43 releasably secures or otherwise retains or maintains adjusting links 27, 29 against displacement from the adjusted positions thereof, respectively. While body 93 of temperature selector 23 and adjusting links 27, 29 respectively have the configurations illustrated and discussed hereinabove for purposes of disclosure, it is contemplated that various other such bodies and adjusting links having various other configurations may be employed within the scope of the invention so as to meet at least some of the objects thereof.

In the operation of thermostat 21 with adjusting links 27, 29 set in the adjusted positions thereof to define the preselected maximum heating temperature and the preselected minimum cooling temperature for the thermostat, as previously discussed, mode selector 25 may be manually moved to its heat mode position, as best seen in FIG. 9, in the event the operator desires to effect the heating mode operation of the thermostat. Temperature selector may then be manually pivotally moved about its pivot axis 31 to a selected set point or operating temperature, say 70° F. for instance, of the thermostat which is less than or below the preselected maximum heating temperature; however, as previously noted, the engagement between stop surface 47 on adjusting link 29 and abutment 39 on mode selector 25 obviates manual movement of the temperature selector toward temperature settings in excess of the preselected maximum heating temperature when the mode selector is in its heating mode position. Furthermore, as also previously mentioned, any force transmitted from temperature selector 23 to mode selector 25 through the engagement of stop surface 47 with abutment 30 is predeterminately directed generally along radius line 45 of the mode selector toward its pivot axis 37 thereby to obviate displacement movement of the mode selector from its heat mode position in response to such force transferred from the temperature selector. In response to the aforementioned manual pivotal movement of temperature selector 23 to its selected set-point temperature, the gripping engagement of leg 95 on body 93 of the temperature selector with pivot pin 33 effects the conjoint pivotal movement thereof in thermostat base 51. Since bimetal element 65 is carried on pivot pin 33, the bimetal element is also conjointly rotatable or pivotally movable with the pivot pin and temperature selector 23 toward a position correlative with the set point temperature indicated by the temperature selector. Of course, this conjoint rotation of bimetal element 65 with pivot pin 33 is translated by carrying bracket 63 into conjoint pivotal movement of magnets 59, 61 about the pivot pin and with respect to switch device 53. Thus, with magnet 59 pivoted closest to switch device 53, as best seen in FIG. 1, an armature thereof (not shown) is magnetically attracted toward magnet 59 thereby placing the switch device in a mode to enable or energize a heating system (not shown) for conditioning the air of the space in which thermostat 21 may be located since mode selector 25 is in its heat mode position, as previously mentioned.

Figure 5:
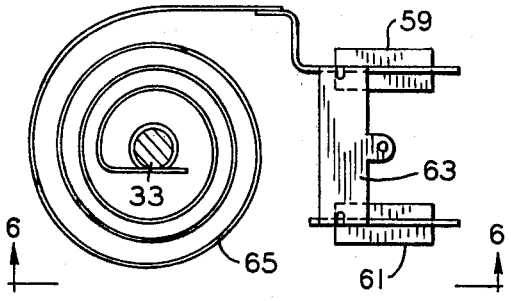
FIG. 5 is an enlarged fragmentary view taken from FIG. 1 showing a switch operation effecting means with a heat anticipator removed therefrom for clarity.

Of course, bimetal element 65 is also movable in its correlative or adjusted position with respect to pivot pin 33 so as to generally wind and unwind in the clockwise and counterclockwise directions thereabout, respectively, in response to the particular temperature of the space sensed by the bimetal element, as best seen in FIG. 5. With the temperature of the space being increased or heated upon the enablement of the heating system and/or anticipator 87, bimetal element 65 expands creating a force tending to move or rotate its radially outer end generally in the counterclockwise direction with respect to pivot pin 33. This increasing torque on bimetal element 65 conjointly pivotally urges carrying bracket 63 and magnets 59, 61 in the counterclockwise direction with respect to shaft 85. Thus, as the temperature of the space is increased to the selected set point temperature of 70° F., the magnitude of the expansive force of bimetal element 65 exceeds that of the attraction force between magnet 59 and the armature of switch device 53 so that bracket 63 and magnets 59, 61 will move with snap action in the counterclockwise direction about pivot pin 33 toward a position in which magnet 66 is disposed closest to switch device 53. Thus, upon this temperature sensing rotation of bimetal element 63 in its correlative position, the armature of switch device 53 is attracted in magnetic coupling relation toward magnet 61 since the attraction force between the armature and magnet 61 is now greater than that between the armature and magnet 59 thereby to disable or deenergize the heating system as well as heat anticipator assembly 87.

With the heating system so deenergized, the temperature of the conditioned air in the space in which thermostat 21 may be located, of course, falls, and at a preselected differential in excess of the selected temperature setting of temperature selector 23, bimetal element 65 will contract to a degree creating a contractive force to effect the return conjoint rotation with snap action of carrying bracket 63 and magnets 59, 61 to their respective correlative positions, as previously mentioned and as best seen in FIG. 1, thereby to reenergize the heating system to again increase the temperature of the conditioned air in the space to the selected set point temperature of 70° F. Of course, this operation of carrying bracket 63 and magnets 59, 61 with bimetal element 65 to effect the switching operation of switch device 53, as previously discussed, in order to control the heating system may be cyclically or periodically repeated in response to the temperature demands of the space in which thermostat 21 is located so as to generally maintain the selected set point temperature of the space.

Further, if the operator desires to effect the cooling operating mode of thermostat 21, mode selector 25 is manually rotated from its heat mode position to its cool mode position, as best seen in FIG. 8, so as to enable or energize a cooling system (not shown) for conditioning the air of the space in which thermostat 21 is located, and the component parts of the thermostat function generally in the same manner as previously described in order to control the operation of the cooling system in response to the temperature demands of the space so as to generally maintain the selected temperature of the space. Of course with mode selector 25 in its cool mode position, temperature selector 23 may be manually pivotally moved about its pivot axis to a selected operating or set point temperature; however, the engagement of stop surface 49 on adjusting link 27 and abutment 39 on the mode selector obviates manual movement of the temperature selector toward temperature settings less than or below the preselected minimum cooling temperature when the mode selector is in its cool mode position. Furthermore and as previously noted, any force transmitted from temperature selector 23 to mode selector 25 in its cool mode position through the engagement of stop surface 49 with abutment 39 is predeterminately directed generally along radius line 45 of the mode selector toward its pivot axis 37 thereby to obviate displacement movement of the mode selector from its cool mode position in response to such force transferred thereto from the temperature selector.

From the foregoing, it is now apparent that a novel thermostat 21, novel methods of manufacturing a thermostat, a novel method of operating a thermostat and a novel method of establishing a preselected maximum heating temperature and a preselected minimum cooling temperature are respectively presented meeting the objects set out hereinbefore, as well as others, and that changes in the precise arrangements, shapes and connections of the constructions illustrated herein by way of example for the purpose of disclosure, as well as the precise steps and orders thereof of the methods, may be made by those having ordinary skill in the art without departing from the spirit of the invention or from the scope thereof as set out in the claims which follow.

What I claim as new and desire to secure by Letters Patent of the United States is:

1. A thermostat adapted to control the energization of a conditioning system operable generally in a heating mode and a cooling mode so as to effect the regulation of a given space in which the thermostat may be located, the thermostat comprising:

a casing including a base;

a post rotatably mounted to said base;

a bimetal element associated with said post so as to be conjointly rotatable therewith and also movable relative to said post in respective ones of a plurality of set positions in response to the temperature of the space sensed by said bimetal element;

means pivotally mounted to said base for selecting an operating mode of the thermostat and movable between a heating mode position, a cooling mode position and an off position, said mode selecting means including an abutment thereon;

a switch device mounted to said base and including means operable generally for switching between a pair of switching positions to effect the energization and deenergization of the conditioning system when said mode selecting means is in its heating mode position and its cooling mode position, respectively;

means associated with said bimetal element and said switch device for translating the temperature sensing movement of said bimetal element in the respective ones of the set positions thereof so as to effect the operation of said switch means between its switching positions;

a temperature selector pivotally movable in response to an operator applied force thereon to a selected set point temperature for the given space and operably connected with said post so as to effect the conjoint rotation of said post and said bimetal element to a respective one of the set positions thereof correlative with the selected set point temperature of said temperature selector;

a pair of adjusting links conjointly pivotally movable with said temperature selector and adjustably movable with respect to said temperature selector to adjusted positions thereon so as to adjustably establish a preselected maximum heating temperature setting and a preselected minimum cooling temperature setting of the thermostat, respectively, said links including a pair of opposite end portions, one of said opposite end portions being pivotally mounted to said post and the other of said opposite end portions being releasably secured to said temperature selector when said links are in the adjusted position thereof; and a pair of means on said links for abutting in engagement with said abutment on said mode selecting means in its heating mode position and its cooling mode position to define the adjusted positions of said links on said temperature selector when it is set in the preselected maximum heating temperature setting and the preselected minimum cooling temperature setting, and the engagement between said abutting means with said abutment on said mode selecting means when said links are in the adjusted positions thereof thereafter obviating the applied force pivotal movement of said temperature selector to a temperature setting past the adjustably established preselected maximum heating temperature setting and the preselected minimum cooling temperature setting of the thermostat when said mode selector means is in its heating mode position and its cooling mode position, respectively.

2. A thermostat adapted to regulate the temperature of a given space comprising:

means for selecting an operating mode of the thermostat and movable at least between a heating mode position and a cooling mode position;

means selectively movable for setting a selected operating temperature of the thermostat and having a preselected maximum heating set point temperature and a preselected minimum cooling set point temperature; and a pair of means separately adjustably movable with respect to at least one of said temperature setting means and said mode selecting means into adjusted positions when the temperature setting means is selectively moved into its preselected maximum heating set point temperature and its preselected minimum cooling set point temperature and operable generally in the adjusted positions thereof for abutting in engagement with the other of said temperature setting means and said mode selecting means when said mode selecting means is in its heating mode position and its cooling mode position so as to define the preselected maximum heating set point temperature and the preselected minimum cooling set point temperature of said temperature setting means, respectively.

3. A thermostat as set forth in claim 2 wherein the other of said temperature setting means and said mode selecting means includes abutment means for effecting the engagement with said abutting means, respectively.

4. A thermostat as set forth in claim 2 wherein said abutting means comprise a pair of links each having a pair of opposite end portions, one of said opposite end portions of said links being pivotally arranged with respect to said at least one of said temperature setting means and said mode selecting means, and means associated with the other of said end portions of said links for releasably securing said other end portions with said other of said temperature setting means and said mode selecting means in the adjusted positions of said links, respectively.

5. A thermostat as set forth in claim 2 wherein said abutting means includes a pair of abutments, and a third abutment on said other of said temperature setting means and said mode selecting means to effect the engagement with said abutment pair on said abutting means, respectively.

6. A thermostat adapted to regulate the temperature of a given space comprising:

a mode selecting lever pivotally movable in the thermostat generally about a preselected axis and between a cooling mode position and a heating mode position through an off position;

a temperature setting lever pivotally movable in the thermostat in response to an operator applied force to a set point temperature at least when said mode selecting lever is in its heating mode position and its cooling mode position; and means on said mode selecting lever for abutment in engagement with said temperature setting lever to establish a preselected maximum heating set point temperature and a preselected minimum cooling set point temperature and also to obviate the operator applied force movement of said temperature setting lever beyond such preselected set point temperatures when said mode selecting lever is in its heating mode position and its cooling mode position, respectively, and the force of the engagement between said abutment means and said temperature setting lever being directed generally along a radius line emanating from the preselected axis of said mode selecting lever point and extending through said abutment means so as to prevent displacement movement of said mode selector from one of the heating mode position and the cooling mode position thereof into the off position thereof in response to the operator applied force exerted on the temperature setting lever.

7. A method of establishing a preselected maximum heating set point temperature and a preselected minimum cooling set point temperature of a thermostat, the thermostat having means operable generally for setting a selected set point temperature means operable generally for selecting an operating mode of the thermostat and having a heating mode position and a cooling mode position, and a pair of adjusting means associated with one of the temperature setting means and the mode selecting means and adapted for adjustable movement with respect thereto, the method comprising the steps of:

setting the temperature setting means in one of the preselected maximum heating set point temperature and the preselected minimum cooling set point temperature with the mode selector means in one of the heating mode position and the cooling mode position thereof and adjusting one of the adjusting means with respect to the one of the temperature setting means and the mode selecting means to an adjusted position thereon and into abutting engagement with the other of the temperature setting means and the mode selecting means thereby to establish the one of the preselected maximum heating set point temperature and the preselected cooling set point temperature; and moving the temperature setting means to the other of the preselected maximum heating set point temperature and the preselected minimum cooling set point temperature and the mode selecting means to the other of the heating mode position and the cooling mode position thereof and adjusting the other of the adjusting means with respect to the one of the temperature setting means and the mode selecting means to another adjusted position thereon and into abutting engagement with the other of the temperature setting means and the mode selecting means thereby to establish the other of the preselected maximum heating set point temperature and the preselected minimum cooling set point temperature.

8. The method as set forth in claim 7 comprising the intermediate step of securing the one adjusting means in its adjusted position to the one of the temperature setting means and the mode selecting means so as to be conjointly movable therewith during the moving and adjusting step.

9. The method as set forth in claim 7 comprising the additional step of securing the other adjusting means in its another adjusted position to the one of the temperature setting means and the mode selecting means.

10. The method as set forth in claim 7 wherein the other of the temperature setting means and the mode selecting means has abutment means for the abutting engagement with the one adjusting means in the adjusted position thereof and the other adjusting means in the another adjusted position thereof, respectively.

11. A method of establishing a preselected maximum heating set point temperature and a preselected minimum cooling set point temperature of a thermostat having a pivotally movable temperature selector, a mode selector having a heating mode position and a cooling mode position and having an abutment thereon, and a pair of adjusting links pivotally movable with respect to the temperature selector, the method comprising the steps of:

setting the temperature selector in one of the preselected maximum heating set point temperature and the preselected minimum cooling set point temperature with the mode selector in one of the heating mode positions and the cooling mode positions thereof and adjusting one of the links pivotally with respect to the temperature selector into an adjusted position thereon in abutting engagement with the abutment on the mode selector; and moving the temperature selector with the one link in its adjusted position thereon to the other of the preselected maximum heating temperature setting and the preselected minimum cooling temperature setting and the mode selector to the other of the heating mode position and the cooling mode position thereof and adjusting the other of the links pivotally with respect to the temperature selector into another adjusted position thereon in abutting engagement with the abutment on the mode selector.

12. A method of manufacturing a thermostat with the thermostat including means for setting a selected set point temperature of the thermostat, means for selecting an operating mode of the thermostat and having a heating mode position and a cooling mode position, and a pair of adjustable stops, the method comprising the steps of:

pivotally mounting the temperature setting means and the mode selecting means in the thermostat and associating the adjustable stops with one of the temperature setting means and the mode selecting means;

setting the temperature setting means in one of a preselected maximum heating set point temperature and a preselected minimum cooling set point temperature with the mode selecting means in one of the heating mode position and the cooling mode position thereof; and adjusting one of the adjustable stops associated with the one of the temperature setting means and the mode selecting means toward an adjusted position into abutting engagement with the other of the temperature setting means and the mode selecting means thereby to define the one of the preselected maximum heating set point temperature and the preselected minimum cooling set point temperature.

13. The method as set forth in claim 12 wherein the other of the temperature setting means and the mode selecting means includes means for abutment with the adjustable stops, respectively, and wherein the adjusting step includes predeterminately directing the force of the engagement between the one adjustable stop in its adjusted position and the abutment means generally along a radius line extending through the abutment means and emanating from a pivot axis of the other of the temperature setting means and the mode selecting means.

14. The method as set forth in claim 12 comprising the additional step of securing the one adjustable stop in its adjusted position to the one of the temperature setting means and the mode selecting means.

15. The method as set forth in claim 12 comprising the additional step of moving the temperature setting means to the other of the preselected maximum heating set point temperature and the preselected minimum cooling set point temperature and the mode selecting means to the other of the heating mode position and the cooling mode position thereof and adjusting the other of the adjustable stops to another adjusted position into engagement with the other of the temperature setting means and the mode selecting means thereby to define the other of the preselected maximum heating set point temperature and the preselected minimum cooling set point temperature.

16. The method as set forth in claim 15 comprising the further additional step of securing the other adjusting stop in its another adjusted position to the one of the temperature setting means and the mode selecting means.

17. The method as set forth in claim 15 wherein the other of the temperature setting means and the mode selecting means includes means for abutment with the adjustable stops, respectively, and wherein the moving and adjusting step includes predeterminately directing the force of the engagement between the other adjustable stops in its another adjusted position and the abutment means generally along a radius line extending through the abutment means and emanating from a pivot axis of the other of the temperature setting means and the mode selecting means.

18. A method of manufacturing a thermostat having a base, a temperature selector, a mode selector with an abutment thereon, a pair of adjusting links, and a post, the method comprising the steps of:

pivotally mounting the post and the mode selector to the base with the mode selector being pivotally movable between a heating mode position and a cooling mode position through an off position;

associating the temperature selector and the adjusting links with the post so as to be conjointly rotatable therewith;

setting the temperature selector in one of a preselected maximum heating temperature setting and a preselected minimum cooling temperature setting with the mode selector in one of the heating mode positions and the cooling mode positions thereof and pivoting one of said links with respect to the post and the temperature selector into an adjusted position in abutting engagement with the abutment on the mode selector;

securing the one link in its adjusted position to the temperature selector so as to be conjointly pivotally movable therewith and with the post;

moving the temperature selector to the other of the preselected maximum heating temperature setting and the preselected minimum cooling temperature setting and the mode selector to the other of the heating mode position and the cooling mode position and pivoting the other of the links with respect to the post and the temperature selector into another adjusted position in abutting engagement with the abutment on the mode selector; and connecting the other links in its another adjusted position to the temperature selector so as to be conjointly pivotally movable therewith and with the post.

19. A method of manufacturing a thermostat, the thermostat including a temperature selector with a pivot axis and having a preselected maximum heating set point temperature and a preselected minimum cooling set point temperature, a pair of adjustable stops associated with the temperature selector, a mode selector with a pivot axis and having a heating mode position and a cooling mode position, and an abutment on the mode selector, the method comprising the steps of:

positioning the abutment on the mode selector so that a radius line emanating from the pivot axis of the mode selector intersects with the abutment;

mounting the temperature selector and the mode selector about the respective pivot axis thereof in the thermostat; and arranging the stops to engage the abutment with the mode selector in its heating mode position and its cooling mode position thereby to establish the preselected maximum heating set point temperature and the preselected cooling set point temperature of the temperature selector and directing the forces of the engagements between the stops and the abutment generally along the radius line emanating from the pivot axis of the mode selector and intersecting with the abutment.

20. A method of operating a thermostat with the thermostat including a temperature selector having a preselected maximum heating set point temperature and a preselected minimum cooling set point temperature, and a mode selector having a heating mode position and a cooling mode position, the method comprising the steps of:

engaging with the mode selector in the heating mode position and the cooling mode position thereof the temperature selector upon its movement in response to an operator applied force into the preselected maximum heating set point temperature and the preselected minimum cooling set point temperature, respectively; and directing the operator applied force transferred from the temperature selector to the mode selector during the engagement thereof generally along a radius line extending generally between the location of the engagement of the temperature selector with the mode selector and a pivot axis of the mode selector and obviating thereby displacement movement of the mode selector from the heating mode position and the cooling mode position thereof in response to the operator applied force transferred to the mode selector during its engagement with the temperature selector.

21. The method as set forth in claim 20 wherein the mode selector includes means intersected by the radius line and adapted for the engagement with the temperature selector.

22. The method as set forth in claim 20 wherein the engaging step includes abutting one abutment of a pair thereof associated with the temperature selector in the engagement with the mode selector in the one of its heating mode position and its cooling mode position upon the movement of the temperature selector into the one of the preselected maximum heating set point temperature and the preselected minimum cooling set point temperature in response to the operator applied force.

23. The method as set forth in claim 22 wherein the abutments are adjustable with respect to the temperature selector and wherein a peliminary step comprises adjusting the abutments to effect the engagement thereof with the mode selecting means in its heating mode position and its cooling mode position when the temperature selector is in its preselected maximum heating set point temperature and its preselected minimum cooling set point temperature respectively.

24. A method of operating a thermostat, the thermostat including a temperature selector with a pivot axis and having a preselected maximum heating set point temperature and a preselected minimum cooling set point temperature, a pair of stops associated with the temperature selector, a mode selector with a pivot axis and having a heating mode position and a cooling mode position, and an abutment on the mode selector intersected by a radius line emanating from the pivot axis of the mode selector, the method comprising the steps of:

applying an operator force onto the temperature selector and pivoting the temperature selector generally about its pivot axis toward one of the preselected maximum heating set point temperature and the preselected minimum cooling set point temperature;

engaging one of the stops with the abutment of the mode selector in one of its heating mode positions and its cooling mode position upon the operator applied force pivoting of the temperature selector into the one of the preselected maximum heating set point temperature and the preselected minimum cooling set point temperature thereof and transferring the operator applied force to the mode selector through the engagement of the abutment thereof with the one stop; and obviating displacement pivoting of the mode selector about its pivot axis from the one of the heating mode position and cooling mode position of the mode selector in response to the operator applied force transferred to the mode selector through the engagement of the abutment thereof with the one stop.

25. The method as set forth in claim 24 wherein the obviating step comprises directing the operator applied force transferred to the mode selector toward its pivot axis generally along the radius line between the abutment and the pivot axis of the mode selector.

26. The method as set forth in claim 24 wherein the stops are adjustable with respect to the temperature selector and wherein a preliminary step comprises adjusting the stops to adjusted position with respect to the temperature selector defining the preselected maximum heating set point temperature and the preselected minimum cooling set point temperature thereof.

27. A thermostat adapted to regulate the temperature of a given space comprising:

means for selecting an operating mode of the thermostat and movable between a heating mode position and a cooling mode position;

means selectively movable for setting a selected operating temperature of the thermostat and having a preselected maximum heating set point temperature and a preselected minimum cooling set point temperature;

a pair of links each having a pair of opposite end portions, one of said opposite end portions of said links being pivotally arranged with respect to at least one of said temperature setting means and said mode selecting means, and said links being pivotally movable about said one opposite end portion thereof toward adjusted positions abutting with the other of said temperature setting means and said mode selecting means when said mode selecting means is in one of the heating mode position and cooling mode position thereof so as to define the preselected maximum heating set point temperature and the preselected minimum cooling set point temperature of said temperature setting means, respectively; and means associated with the other of said opposite end portions of said links for releasably securing said other opposite end portions with one of said one and other of said temperature setting means and said mode selecting means so as to maintain said links in the adjusted positions thereof, respectively.

28. A thermostat adapted to regulate the temperature of a given space comprising:

means operable generally for selecting an operating mode of the thermostat;

means selectively movable for setting a set point temperature of the thermostat;

means for establishing a preselected maximum heating set point temperature and a preselected maximum cooling set point temperature of said temperature setting means including a pair of means conjointly movable with said temperature setting means and adapted for abutting in engagement with said mode selecting means when said mode selecting means is in a heating operating mode position and a cooling operating mode position thereof so as to define the preselected maximum heating set point temperature and the preselected minimum cooling set point temperature of said temperature setting means, respectively, means on said mode selecting means for abutment with said abutting means when said mode selecting means is in the heating operating mode position and the cooling operating mode position thereof, respectively;

a pair of means for pivotally mounting said temperature setting means and said mode selecting means in preselected locations with respect to each other in the thermostat, said abutment means being predeterminately arranged generally about a radius line emanating from a centerline axis of one of said mounting means for said mode selecting means so that the forces of the engagements of said abutting means with said abutment means are directed generally along the radius line thereby to obviate displacement of said mode selecting means from its heating operating mode position and its cooling operating mode position in response to the forces of the engagements of said abutting means with said abutment means, respectively.

29. A thermostat adapted to regulate the temperature of a given space comprising:

means for selecting an operating mode of the thermostat and movable at least between a heating mode position and a cooling mode position;

means selectively movable for setting a selected operating temperature of the thermostat and having a preselected maximum heating set point temperature and a preselected minimum cooling set point temperature; and means for defining the preselected maximum heating set point temperature and the preselected minimum cooling set point temperature of said temperature setting means including a pair of means arranged on said temperature setting means so as to be adjustably movable with respect thereto toward adjusted positions when the temperature setting means is selectively moved to its preselected maximum heating set point temperature and its preselected minimum cooling set point temperature and operable generally in the adjusted positions thereof for abutting in engagement with a part of said mode selecting means when the mode selecting means is in its heating mode position and its cooling mode position, respectively, said abutting means comprising a pair of links each having a pair of opposite end portions, means in the thermostat for pivotally mounting at least one of said opposite end portions of the links, and a pair of means associated with the other of said end portions of said links for releasably securing said other end portions with said temperature setting means in the adjusted positions of said links, respectively.

30. A thermostat adapted to regulate the temperature of a given space comprising:

means for selecting an operating mode of the thermostat and movable at least between a heating mode position and a cooling mode position;

means selectively movable for setting a selected operating temperature of the thermostat and having a maximum heating set point temperature and a minimum cooling set point temperature;

a pair of means for pivotally mounting said temperature setting means and said mode selecting means at preselected locations with respect to each other in the thermostat, respectively;

a pair of means associated with said temperature setting means so as to be conjointly selectively movable therewith and adapted for abutting in engagement with a part of said mode selecting means when said mode selecting means is in its heating mode position and its cooling mode position thereby to obviate the selective movement of said temperature setting means beyond the preselected maximum heating set point temperature and the preselected minimum cooling set point temperature thereof, respectively, and said mode selecting means part being predeterminately arranged generally with respect to a radius line emanating frpom a centerline axis of one of said pivotally mounting means for said mode selecting means so that the forces of the engagements of said abutting means with said mode selecting means part are directed generally along the radius line thereby to obviate displacement of said mode selecting means from its heating mode position and its cooling mode position in response to the engagements of said abutting means with said mode selecting means part, respectively.

31. A thermostat as set forth in claim 30 further comprising means for adjustably interconnecting said abutting means in a plurality of adjusted positions with said temperature setting means, respectively, said abutting means in respective ones of the respective adjusted positions thereof defining the preselected maximum heating set point temperature and the preselected minimum cooling set point temperature of said temperature setting means upon the engagement of said abutting means with said mode selecting means part when the mode selecting means is in its heating mode position, and its cooling mode position, respectively.

32. A thermostat as set forth in claim 30 wherein said abutting means are respectively pivotally associated with the other of said pivotally mounting means for said temperature setting means.

33. A thermostat as set forth in claim 30 wherein said abutting means include a pair of surfaces predeterminately arranged thereon to effect the engagements with said mode selecting means part at least generally adjacent an intersection of the radius line with said mode selecting means part, respectively.

* * * * *